US011752548B2

(12) United States Patent
Zhang et al.

(10) Patent No.: US 11,752,548 B2
(45) Date of Patent: Sep. 12, 2023

(54) DIE CASTING METHOD FOR FILTERING CAVITY

(71) Applicant: ZHUHAI RUNXINGTAI ELECTRICAL CO., LTD, Zhuhai (CN)

(72) Inventors: Ying Zhang, Zhuhai (CN); Jie Tan, Zhuhai (CN); Jicheng Wang, Zhuhai (CN); Gunan Li, Zhuhai (CN); Ziqiang Huang, Zhuhai (CN); Huaide Ren, Zhuhai (CN)

(73) Assignee: ZHUHAI RUNXINGTAI ELECTRICAL CO., LTD, Zhuhai (CN)

( * ) Notice: Subject to any disclaimer, the term of this patent is extended or adjusted under 35 U.S.C. 154(b) by 243 days.

(21) Appl. No.: 17/413,762

(22) PCT Filed: Dec. 2, 2019

(86) PCT No.: PCT/CN2019/122416
§ 371 (c)(1),
(2) Date: Jun. 14, 2021

(87) PCT Pub. No.: WO2020/119502
PCT Pub. Date: Jun. 18, 2020

(65) Prior Publication Data

US 2022/0032364 A1 Feb. 3, 2022

(30) Foreign Application Priority Data

Dec. 14, 2018 (CN) ..... 201811532158.8

(51) Int. Cl.
*B22D 43/00* (2006.01)
*B22F 1/148* (2022.01)
(Continued)

(52) U.S. Cl.
CPC ..... *B22D 43/004* (2013.01); *B22D 1/00* (2013.01); *B22D 17/007* (2013.01); *B22D 27/02* (2013.01);
(Continued)

(58) Field of Classification Search
CPC ..... B22D 43/004; B22D 1/00; B22D 17/007; B22D 27/02; B22D 27/00; B22D 27/09; B22D 27/11
See application file for complete search history.

(56) References Cited

FOREIGN PATENT DOCUMENTS

CN 1740369 A 3/2006
CN 1970821 A 5/2007
(Continued)

OTHER PUBLICATIONS

English machine translation of CN108286001A (Year: 2018).*
(Continued)

*Primary Examiner* — Kevin P Kerns
*Assistant Examiner* — Steven S Ha
(74) *Attorney, Agent, or Firm* — ANOVA LAW GROUP, PLLC

(57) ABSTRACT

A die casting method includes stirring an aluminum alloy liquid in a stirrer under an airtight vacuum condition. The stirrer includes an electromagnetic inductor and a stirring rod. The aluminum alloy liquid is simultaneously subjected to an electromagnetic stirring in a direction of a magnetic field generated by the electromagnetic inductor and a mechanical stirring under a rotation action of the stirring rod. The aluminum alloy liquid is stirred for 20-80 minutes until the aluminum alloy liquid becomes semisolid to obtain a semisolid aluminum alloy slurry. The method further includes injecting the semisolid aluminum alloy slurry into a filter die to perform die casting molding at an injection speed of 1.5-2.5 m/s, an injection specific pressure of 30-80
(Continued)

MPa, a pressurization pressure of 60-80 MPa, and a temperature of the filter die of 250-400° C., and maintaining pressure for 7-30 seconds to obtain the filtering cavity.

11 Claims, 1 Drawing Sheet

(51) Int. Cl.

| | |
|---|---|
| ***B22D 1/00*** | (2006.01) |
| ***B22D 17/00*** | (2006.01) |
| ***B22D 27/02*** | (2006.01) |
| ***C22F 1/04*** | (2006.01) |
| *B22F 9/08* | (2006.01) |

(52) U.S. Cl.
CPC ..... *B22F 1/148* (2022.01); *C22F 1/04* (2013.01); *B22F 9/08* (2013.01)

(56) References Cited

FOREIGN PATENT DOCUMENTS

| | | | |
|---|---|---|---|
| CN | 102319735 | A | 1/2012 |
| CN | 204396833 | U | 6/2015 |
| CN | 105149549 | A | 12/2015 |
| CN | 205200471 | U | 5/2016 |
| CN | 105648369 | A | 6/2016 |
| CN | 106077568 | A | 11/2016 |
| CN | 106270441 | A | 1/2017 |
| CN | 106636788 | A | 5/2017 |
| CN | 106890974 | A | 6/2017 |
| CN | 106898853 | A | 6/2017 |
| CN | 107498010 | A | 12/2017 |
| CN | 107520418 | A | 12/2017 |
| CN | 108080601 | A | 5/2018 |
| CN | 108213384 | A | 6/2018 |
| CN | 108286001 | A | 7/2018 |
| CN | 107027259 | B | 11/2018 |
| CN | 109732052 | A | 5/2019 |
| JP | S6199401 | A | 5/1986 |
| JP | 2006519704 | A | 8/2006 |
| JP | 2017533655 | A | 11/2017 |
| JP | 2018065160 | A | 4/2018 |
| JP | 2018122330 | A | 8/2018 |
| WO | 2017200275 | A1 | 11/2017 |

OTHER PUBLICATIONS

The World Intellectual Property Organization (WIPO) International Search Report With Translation for PCT/CN2019/122416 dated Feb. 27, 2020 8 pages.

The State Intellectual Property Office of People's Republic of China The First Office Action for Application No. CN201811532158.8 dated Dec. 17, 2019 23 pages (including translation).

The State Intellectual Property Office of People's Republic of China The Second Office Action for Application No. CN201811532158.8 dated Apr. 27, 2020 17 pages (including translation).

Zhenghua Huang et al., "Application and research-progress of die-casting aluminum alloys" Materials Research and Application, Mar. 2017, vol. 11, No. 1.

Yi Qin, "Metallurgical quality control of high-strength aluminum alloy wire rod" The Fifth International Aluminum Profile Technology Seminar& Exposition, Sep. 10-12, 2013, p. 385-386.

Japan Patent Office The Office Action for Application No. JP2021-532144 dated Jun. 23, 2022 13 pages (with translation).

* cited by examiner

DIE CASTING METHOD FOR FILTERING CAVITY

CROSS-REFERENCE TO RELATED APPLICATIONS

This application is a national stage entry under 35 U.S.C. § 371 of International Application No. PCT/CN2019/122416, filed on Dec. 2, 2019, which claims priority to Chinese Patent Application No. 201811532158.8, filed on Dec. 14, 2018, and entitled "Die casting method for filtering cavity," the entire contents of both of which are incorporated in this application by reference.

TECHNICAL FIELD

The present application relates to the field of metal materials, in particular, to a die casting method for a filtering cavity.

BACKGROUND

With the improvement of the integration degree of signal electrical devices of 4G/5G wireless communication base station, the die casting size of cavity filter increases, the equipment becomes heavier and heavier, and the heat dissipation requirements become higher and higher. Domestic and foreign carriers all put forward clear index requirements for wireless base stations with high thermal conductivity, light weight and low cost. Aluminum alloy die casting is the key structural material of wireless base station, which provides a foundation for the fixation of electronic components and circuit boards in the base station. At the same time, the working heat of electrical components is exported through the heat sink, which is the main component of the base station signal transmission box for heat dissipation and cooling down. In order to improve the heat dissipation efficiency of the base station cavity filter, measures such as increasing the height if the heat sink and thinning the heat sink are adopted in the structural design. Due to the limitation of the liquid die casting production process, weight reducing in the structure of the cavity filter, and height increasing and thinning in the heat sink have reached the limit. It is needed to consider use other die casting production processes for the cavity filter to achieve high thermal conductivity, light weight and low cost.

Die casting is a liquid forming method. Because of the fast injection speed, the liquid is easy to form turbulence in the mold cavity, and the air in the mold cavity is involved in the product; at the moment when the liquid touches the mold, the temperature difference is large, and the liquid on the surface solidifies rapidly, which increases the flow resistance of the core liquid, so it cannot be fused well to form a cold barrier. At the same time, the introduction of oxides or some other impurities in the melting and casting process of the alloy eventually leads to the degradation of product performance.

Therefore, it is an urgent technical problem to provide a die casting method for producing filtering cavity with high thermal conductivity, light weight and low cost.

SUMMARY

According to one aspect of the present application, there is provided a die casting method for a filtering cavity, comprising: (1) transferring an aluminum alloy liquid to a stirrer provided with an electromagnetic inductor and a stirring rod, wherein the stirring rod is arranged across the inside of the stirrer; (2) covering the stirrer and evacuating the air inside the stirrer; (3) starting the stirrer to stir the aluminum alloy liquid under an airtight vacuum condition, so that the aluminum alloy liquid is electromagnetically stirred in the direction of a magnetic field generated by the electromagnetic inductor, and simultaneously mechanically stirred under a rotation action of the stirring rod; the aluminum alloy liquid is stirred until the aluminum alloy liquid becomes semisolid and stirring is stopped to obtain a semisolid aluminum alloy slurry, wherein a stirring time is set to be 20-80 minutes, and a temperature of the semisolid aluminum alloy slurry is 550-650° C.; (4) injecting the semisolid aluminum alloy slurry obtained in the step (3) into a filter die, performing die casting molding at an injection speed of 1.5-2.5 m/s, an injection specific pressure of 30-80 MPa and a pressurization pressure of 60-80 MPa, and maintaining the pressure for 7-30 seconds to obtain a filtering cavity, wherein the temperature of the filter die is set to 250-400° C.

Optionally, the step (4) specifically comprises the following steps: (4.1) preparing a filter die and spraying a lubricant into the die cavity; (4.2) injecting the semisolid aluminum alloy slurry into the filter die, wherein the injection pressure is set to 100-175 MPa, the injection speed is set to 1.5-2.5 m/s, the injection specific pressure is set to 30-50 MPa, and the pressurization pressure is set to 60-80 MPa; and performing die casting molding; (4.3) after the die casting molding, keeping the pressure at 100-175 MPa for 7-15 seconds until the casting of the filtering cavity is solidified, and then cooling to obtain the filtering cavity.

Optionally, before the step (1), the method further comprises a preparation step a: preparing an aluminum alloy, and heating the aluminum alloy to melt to obtain the aluminum alloy liquid, wherein the temperature of the aluminum alloy liquid is 700-750° C.

Optionally, before the step (1), the method further comprises a preparation step b: putting the aluminum alloy liquid obtained in the preparation step a into a spraying device, carrying out powder spraying refining with inert gas as a carrier, and performing primary degassing to remove bubbles in the aluminum alloy liquid, wherein a refining time is set to 8-18 minutes, and the aluminum alloy liquid is filtered after standing for 15-30 minutes after refining.

Optionally, before the step (1), the method further comprises a preparation step c: transferring the aluminum alloy liquid refined by powder spraying in the preparation step b to a rotor degassing device, and blowing nitrogen into the aluminum alloy liquid for secondary degassing, wherein a rotor speed of the rotor degassing device is set to 500-600 rpm.

Optionally, the stirring of the graphite stirring rod in step (4) is rotary stirring from a center of the stirrer to an edge of the stirrer.

Optionally, the stirring of the stirring rod in step (4) further comprises stirring up and down.

Optionally, the magnetic field generated by the electromagnetic inductor of the stirrer in step (3) is a rotating magnetic field or a traveling wave magnetic field.

Optionally, the die casting method for a filtering cavity of the present application further includes step (5) after step (4): subjecting the filtering cavity after die casting molding in step (4) to solution treatment at 545-550° C. for 6-8 hours followed by water quenching.

Optionally, the die casting method for a filtering cavity of the present application further includes step (6) after step (5): subjecting the filtering cavity quenched in water in step (5) to aging treatment at 185-250° C. for 3-5 hours.

Wherein, an injection specific pressure is the pressure on the die-cast liquid metal per unit area. The selection of the injection specific pressure is determined according to the structural characteristics of different alloys and castings. Regarding the choice of injection speed, for castings with thick walls or high internal quality requirements, lower filling speed and high pressurization pressure are selected; for castings with thin walls or high surface quality and complex castings, higher injection specific pressure and high filling speed are selected.

The pressurization pressure is established when the mold is filled with alloy and in liquid or semi-liquid state, so that pressurization can play a role in all parts of the casting. The effect of pressurization is to reduce the porosity of castings and the influence of porosity and shrinkage on the quality of castings. The supercharging pressure acting on the alloy is selected by die casting experience, and is determined according to the requirements of the casting on alloy density, strength and machining position. The pressurization pressure recommended by Buehler Company is 40 Mpa for general aluminum, magnesium and copper die castings, 40-60 Mpa for important castings and 80-100 Mpa for castings with air tightness requirements. For thin-walled castings, the pressurization of 36-60 Mpa can be selected; for thick-walled die castings, the pressurization can be 60-80 MPa, and usually the pressurization can be selected in the range of 40-70 Mpa.

The purpose of solution treatment is to dissolve carbides and y' phase in the matrix to obtain a uniform supersaturated solid solution, which is convenient for re-precipitation of strengthening phases such as carbides and y' with fine particles and uniform distribution during aging treatment, and at the same time, eliminate the stress caused by cold and hot processing, and recrystallize the alloy. Secondly, the solution treatment is to obtain a suitable grain size to ensure the creep resistance of the alloy at high temperature. The temperature range of solution treatment is about 980-1250° C., which is mainly selected according to the precipitation and dissolution rules and application requirements of each alloy, so as to ensure the necessary precipitation conditions and certain grain size of the main strengthening phase.

The die casting method of the filtering cavity of the application includes aging treatment at 200-205° C. for 3-5 hours, and cooling along with the furnace to obtain the filtering cavity. The purpose is to keep the temperature of the filtering cavity at 200-205° C. by controlling the heating speed. The filtering cavity is cooled after 3-5 hours of heat preservation so as to change the internal organization of the filtering cavity, improve its mechanical properties, enhance its corrosion resistance, improve its processability and obtain dimensional stability.

According to the die casting method of the filtering cavity, electromagnetic stirring and mechanical stirring are simultaneously applied in the solidification process of the aluminum alloy liquid, so that the branched primary solid phase in the aluminum alloy liquid is fully broken, and the solid-liquid mixed slurry with spherical, ellipsoidal or rose primary solid phase uniformly suspended in the liquid metal parent phase is obtained, namely a semisolid aluminum alloy slurry.

In the die casting method of the filtering cavity, the aluminum alloy liquid generates induced current under the action of the magnetic field generated by the electromagnetic sensor. The induced current interacts with the magnetic field generated by the electromagnetic sensor to generate electromagnetic force for pushing the aluminum alloy liquid to flow. The aluminum alloy liquid is electromagnetically stirred along the magnetic field direction under the action of the electromagnetic force, and the mechanical stirring of the stirring rod is to rotate and stir the aluminum alloy liquid from the stirrer center to the stirrer edge, thus destroying the electromagnetic stirring process of the aluminum alloy liquid. The collision strength of aluminum alloy liquid is further increased, so that the size of α-Al grains in the semisolid aluminum alloy slurry is smaller and the sphericity is higher, and the semisolid aluminum alloy slurry has better fluidity, which is more conducive to die casting forming of the semisolid aluminum alloy slurry.

According to the die casting method of the filtering cavity disclosed by the application, the semisolid technology is applied to the production field of the cavity filter; compared with the conventional common liquid die casting molding process, the common liquid die casting is injection mold filling, but during semisolid molding, metal mold filling is stable, turbulence and splashing are not likely to occur, and metal oxidation and gas entrapment are reduced; and the prepared filtering cavity has compact internal structure, few defects such as pores and segregation, fine grains, high mechanical properties and improved mechanical properties, and its strength is higher than that of conventional liquid metal die castings.

The die casting method of the filtering cavity has the advantages of short solidification time, low processing temperature and small solidification acceptance rate, improves the dimensional accuracy of castings, improves the productivity of products, saves the production cost, and is more suitable for wide industrial application. Part of latent heat of crystallization has been released in the process of stirring aluminum alloy liquid into the semisolid aluminum alloy slurry, which reduces the thermal shock generated by subsequent die casting molding. The shear stress generated during die casting molding of the semisolid aluminum alloy slurry is at least three orders of magnitude smaller than that of conventional dendritic slurry, so the obtained filtering cavity has stable mold filling, small thermal load, reduced thermal fatigue strength and longer service life.

Due to the fine grains of semisolid aluminum alloy slurry, turbulence and splashing are not easy to occur in die casting molding, so the weight of filtering cavity obtained by die casting is reduced, the wall thickness is reduced, and the heat conduction efficiency is improved. In addition, the filtering cavity obtained by the semisolid aluminum alloy slurry die casting has few defects and high molding rate, and the qualified rate of products can reach above 95%, which can greatly reduce the subsequent blank processing process, reduce the processing cost and reduce the energy consumption.

According to the die casting method of the filtering cavity disclosed by the application, the temperature during die casting of semisolid aluminum alloy slurry is 550-650° C., thus getting rid of the high-temperature liquid metal environment of conventional die casting, accelerating the solidification speed, improving the productivity and shortening the process cycle.

The die casting method of the filtering cavity is suitable for computer aided design and manufacture, improves the automation degree of production, is suitable for mass production, and lays a foundation for wide application in the future.

The die casting method of the filtering cavity has the advantages that:

1. According to the die casting method of the filtering cavity, the weight of the filtering cavity obtained by die casting is reduced, the wall thickness is thinned, and the heat conduction efficiency is improved.

2. In the die casting method of the filtering cavity of the present application, electromagnetic stirring and mechanical stirring are combined, so that the size of α-Al grains in the semisolid aluminum alloy slurry is smaller and the sphericity is higher, and the fluidity of the semisolid aluminum alloy slurry is better.

3. The die casting method of the filtering cavity of the application has high molding rate, which can greatly reduce the subsequent blank processing process, reduce the processing cost and reduce the energy consumption.

4. Compared with the conventional direct die casting of liquid metal, the die casting method of the filtering cavity of the present application has short solidification time and low processing temperature, which not only improves the dimensional accuracy of the filtering cavity, but also improves the productivity of products.

BRIEF DESCRIPTION OF DRAWINGS

The accompanying drawings, which are incorporated in and constitute a part of the specification, illustrate embodiments of the present application and, together with the description, serve to explain the principles of the application. In these drawings, similar reference numerals are used to denote similar elements. The drawings in the following description are some, but not all, embodiments of the present application. For those skilled in the art, other drawings can be obtained according to these drawings without paying creative labor.

DESCRIPTION OF EMBODIMENTS

Figure 1:
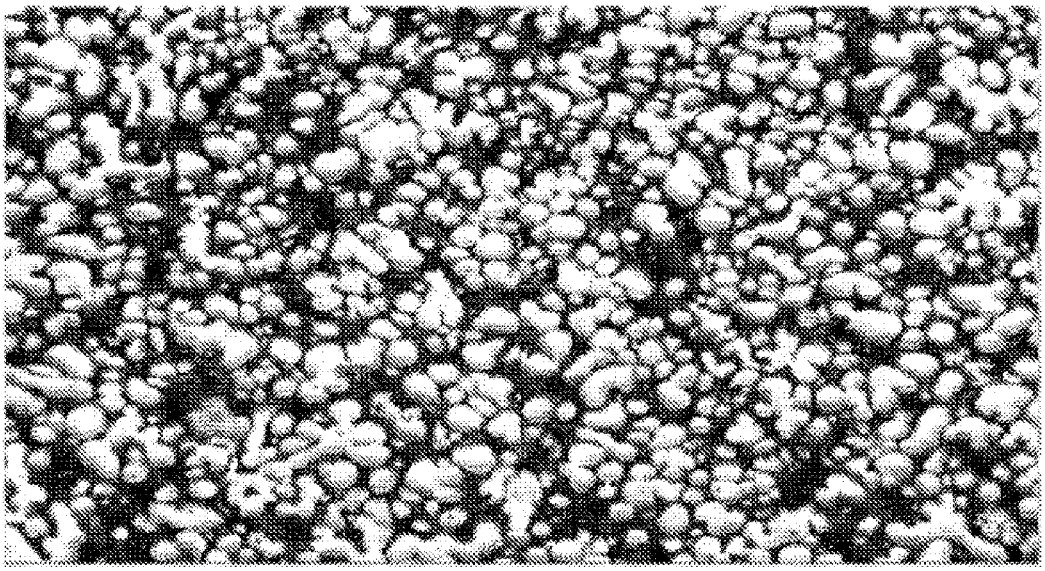
FIG. 1 is an internal crystal structure of a filtering cavity prepared by the die casting method of the filtering cavity of the present application.

In order to make the purpose, technical solution and advantages of the embodiments of the present application clearer, the technical solution of the present application will be described clearly and completely in combination with the embodiments of the present application. Obviously, the described embodiments are some embodiments of the present application, not all embodiments. Based on the embodiments of the present application, all other embodiments obtained by ordinary technicians in the field without creative labor belong to the scope of protection of the present application. It should be noted that the embodiments in this application and the features in the embodiments can be arbitrarily combined with each other without conflict.

The die casting method of the filtering cavity provided by the present application will be explained in detail by means of specific embodiments.

The application provides a die casting method of a filtering cavity, which includes the following steps:

Step 1S: an aluminum alloy is prepared and heated to melt to obtain aluminum alloy liquid, wherein silicon-aluminum alloy, zinc-aluminum alloy, copper-aluminum alloy and magnesium-aluminum alloy can be selected as raw materials. Preferably, $AlSi_8$ aluminum alloy can be selected as the raw material, so that the obtained filtering cavity has higher thermal conductivity, thinner wall thickness and high light weight. The temperature of the aluminum alloy liquid is about 700-750° C. Preferably, 700-735° C. can be selected, and the molding rate of the filtering cavity obtained at this temperature is higher, which can reach more than 90%. For example, 700° C., 720° C. or 735° C. can be selected in the actual operation process.

Step 2S: the obtained aluminum alloy liquid is transferred to a spray gun within the refining temperature range, for example, the refining temperature range can be 700-740° C.; powder spraying refining is carried out with inert gas as a carrier, an iron pipe is inserted into the aluminum alloy liquid for horizontal movement when the refining agent is sprayed, the insertion depth should be ⅔ of the depth of the end of the iron pipe in the aluminum alloy liquid; the iron pipe is moved back and forth, left and right several times to remove bubbles in the aluminum alloy liquid, and the refining time is set to 8-18 minutes, and the aluminum alloy liquid is filtered after standing for 15-30 minutes after refining. Wherein the inert gas can be one or more of $N_2$, Ar, He, Kr or other inert gases, and preferably, $N_2$ can be selected, which is convenient to obtain materials and low in cost. Preferably, the refining time is set to 12-18 minutes, and the aluminum alloy liquid is left to stand for 25-30 minutes after refining, so that hydrogen in the aluminum alloy liquid can be removed to a greater extent and impurities in the aluminum alloy liquid can be reduced, so that the prepared filtering cavity has higher molding rate and reduces impurity content in the aluminum alloy liquid to a greater extent. In this way, the molding rate can reach more than 92%. For example, in the actual operation process, the refining time can be set to 15 minutes, and the aluminum alloy liquid can stand for 28 minutes after refining.

Step 3S, the aluminum alloy liquid refined by powder spraying is transferred to a rotor degassing device, and inert gas is blown into the aluminum alloy liquid for secondary degassing, wherein the rotor rotating speed of the rotor degassing device is set at 500-600 revolutions per minute, and the pressure of the blown inert gas is 10-15 Mpa. The rotor degassing device can be a graphite rotor degassing device. Preferably, the rotor speed of the rotor degassing device can be selected as 500-550 revolutions per minute, and under this condition, the ejected bubbles can quickly and uniformly diffuse into the whole aluminum alloy liquid, so as to avoid the stagnation of larger bubbles in the aluminum alloy liquid caused by too slow rotation speed, and avoid the aluminum alloy liquid tumbling caused by too fast collision between bubbles and aluminum alloy liquid to introduce hydrogen or other impurities into the aluminum alloy liquid to cause pollution. For example, in the actual operation process, the rotor speed can be selected as 500 rpm, 525 rpm, 540 rpm or 550 rpm. Preferably, the pressure of the blown inert gas is 12-13 MPa, and the inert gas can be $N_2$, or one or more of Ar, He, Kr or other inert gases. For example, in the actual operation process, $N_2$ can be selected, which is convenient for obtaining materials and low in cost.

Step 4S, the aluminum alloy liquid subjected to secondary degassing is transferred to a stirrer with an electromagnetic inductor inside, wherein the stirrer is internally provided with a stirring rod arranged across the inside of the stirrer. The material of the stirring rod can be graphite or ceramic, so as to avoid high-temperature stirring aluminum alloy liquid corroding the stirring rod, improve the repeated utilization rate of the stirring rod, prolong the service life of the stirring rod, prevent the corroded stirring rod components from polluting the aluminum alloy liquid, and ensure the quality of the prepared filtering cavity.

Step 5S, the stirrer is covered, the air inside the stirrer is evacuated, and the aluminum alloy liquid is stirred under this condition, which shortens the time needed to stir the aluminum alloy liquid into semisolid, and avoids the introduction of hydrogen during the stirring process of the aluminum alloy liquid. This step is a preferable step, which can be omitted in the actual operation process.

Step 6S, the stirrer is started to stir the aluminum alloy liquid under an airtight vacuum condition, a magnetic field is generated by an electromagnetic inductor; the graphite stirring rod rotates and stirs from the center of the stirrer to the edge of the stirrer back and forth while stirring up and down, so that the aluminum alloy liquid is mechanically stirred under the rotation action of the graphite stirring rod while being electromagnetically stirred; the stirring time is set to 20-80 minutes, and the aluminum alloy liquid is stirred until it becomes semisolid and stirring is stopped to obtain a semisolid aluminum alloy slurry with a temperature of 500-650° C.; the magnetic field generated by electromagnetic reactor is a rotating magnetic field, a traveling wave magnetic field or alternating circulation of a rotating magnetic field and a traveling wave magnetic field; the aluminum alloy liquid generates induced current under the action of magnetic field generated by electromagnetic sensor, with an induced current of 500-600 A and current density of 15-30 A/cm$^2$; the interaction between the induced current and the magnetic field generated by the electromagnetic sensor generates electromagnetic force to push the aluminum alloy liquid to flow, and the aluminum alloy liquid is electromagnetically stirred along the magnetic field direction under the action of electromagnetic force; preferably, the magnetic field generated by the electromagnetic reactor is the alternating circulation of rotating magnetic field and traveling wave magnetic field; under this condition, the size of α-Al grains in the semisolid aluminum alloy slurry obtained is smaller, the sphericity is higher, the fluidity is better, and it is more conducive to die casting forming of the filtering cavity. Preferably, the induced current is 520-550 A, and the current density is 20-25 A/cm$^2$; under this condition, the branched primary solid phase in the aluminum alloy liquid can be fully broken to form a spherical, ellipsoidal or rose primary solid phase which is uniformly suspended and dispersed in the aluminum alloy liquid parent phase. The graphite stirring rod rotates and stirs back and forth from the center of the stirrer to the edge of the stirrer in a circle, and simultaneously lifts and stirs up and down to destroy the electromagnetic stirring process of the aluminum alloy liquid, so that the stirring collision of the aluminum alloy liquid is more intense, crystal grains in the obtained semisolid aluminum alloy slurry are three to five orders of magnitude smaller than that of the conventional dendritic slurry, and the average crystal grain size is 25~50 um, so that the obtained filtering cavity has stable filling, small thermal load, reduced thermal fatigue strength and longer service life. Preferably, the temperature of the obtained semisolid aluminum alloy slurry is 530-570° C. Under this temperature condition, the semisolid aluminum alloy slurry releases the latent heat generated by solidification and crystallization of aluminum alloy liquid to a greater extent, reduces the thermal shock generated by the subsequent die casting process on the filtering cavity, reduces the shear stress generated during die casting, and the obtained filtering cavity has a longer service life. The stirring mode of electromagnetic stirring cooperating with mechanical stirring makes the grain size inside the semisolid aluminum alloy slurry smaller and more evenly distributed, so that the prepared filtering cavity has no porosity and no shrinkage cavity, and the deformation is smaller than that of the filtering cavity obtained by conventional liquid die casting. The formed semisolid aluminum alloy slurry has high internal grain sphericity and better thermal conductivity, and the thickness of the prepared filtering cavity is thinner than that obtained by conventional liquid die casting. For example, the minimum wall thickness of the filtering cavity obtained by conventional liquid die casting is 2 mm, and the minimum wall thickness of the filtering cavity obtained by die casting method of the present application can reach 1 mm. As the wall thickness becomes thinner, the filtering cavity obtained by die casting method of the filtering cavity of the present application is lighter in weight, developing towards lightweight components and expanding the development of filtering cavity.

Step 7S, the semisolid aluminum alloy slurry obtained in step 6S is injected into a filter die cavity, and is subjected to die casting molding at an injection speed of 1.5-2.5 m/s, an injection specific pressure of 30-80 MPa, and a pressurization pressure of 60-80 MPa, and the pressure is maintained for 7-30 seconds to obtain a filtering cavity, wherein the temperature of the filter die is set at 250-400° C. Preferably, the injection speed is 1.8-2.2 m/s, at which the solidification time of semisolid slurry is shortened and the molding rate is higher. For example, in the actual operation process, the injection speed of 1.8 m/s, 1.9 m/s, 2.0 m/s or 2.2 m/s can be selected. Preferably, the injection specific pressure is 45-80 MPa, and the filtering cavity obtained under this pressure has thinner wall thickness and lighter weight. For example, in the actual operation process, the injection specific pressure of 45 MPa, 55 MPa, 65 MPa and 80 MPa can be selected. Preferably, the pressurization pressure is 60-70 MPa, and the filtering cavity obtained by die casting under this condition has higher strength and more wear resistance. For example, in the actual operation process, the pressurization pressure of 60 MPa, 65 MPa or 70 MPa can be selected. Preferably, the holding time is set to 10-15 seconds. Under this condition, the obtained filtering cavity is more complete and has a high molding rate, which avoids the indefinite shape of the filtering cavity caused by shorter holding time and the prolonged production cycle caused by longer holding time. Preferably, the temperature of the filter mold is set at 300-350° C., and the filtering cavity obtained under this condition is easier to demould and can be directly electroplated without grinding.

Step 8S, the filtering cavity obtained in step 7S is subjected to solution treatment for 6-8 hours at the temperature of 545-550° C., and then water quenched. Preferably, the solution temperature is 545-548° C. and the solution time is 6.5-7.5 hours, and then the obtained filtering cavity is solution treated at this temperature to eliminate the shear stress generated in the die casting process, dissolve the carbide and y' phase in the filtering cavity to make the carbide distribution in the filtering cavity more uniform, recrystallize the alloy components, and improve the high temperature creep resistance of the filtering cavity. For example, in the actual operation process, when the solution temperature is 545° C., the solution time is 7 hours; when the solution temperature is 547° C., the solution time is 7 hours or when the solution temperature is 548° C., the solution time is 6.5 hours.

Step 9S, aging treatment is carried out on the water-quenched filtering cavity in the step 8S for 3-5 hours under the condition of 185-250° C., preferably, the aging temperature is 200-225° C., and under this condition, strengthening phases such as carbide, y' with fine particles and uniform distribution are re-precipitated in the filtering cavity to improve the crystal roundness in the filtering cavity; for example, in the actual operation process, the aging temperature can be selected to be 200° C., 210° C., 215° C., 220° C.

or 225° C. Preferably, the aging treatment time is 3.5-4.5 hours. Under this condition, the grain roundness in the filtering cavity obtained by aging treatment is as high as 75%, which increases the heat conduction efficiency of the filtering cavity. For example, in actual operations, the aging treatment time can be selected as 3.5 hours, 4 hours or 4.5 hours.

Further, the parameter comparison between the filtering cavity obtained by the die casting method in the embodiment of the present application and the filtering cavity obtained by the conventional liquid die casting method is given in Table 1 below. For details, please refer to Table 1 for comparison between the filtering cavities prepared by the present application and the conventional process.

TABLE 1

Comparison table of filter cavities prepared by this application and conventional process

| | Products of this application (semisolid die castings) | Conventional filtering cavity |
|---|---|---|
| Process | Semisolid die casting | Conventional liquid die casting |
| Material | $AlSi_8$ | $ADC_{12}$ |
| Coefficient of thermal conductivity W/(m · K) | 145 | 92 |
| Deformation amount | 0.3 mm | 0.5 mm |
| Minimum wall thickness | 1.0 mm | 2.0 mm |
| Air hole condition | No air holes or shrinkage holes | There are air holes and shrinkage holes |
| Light weight | Lose 1000 g | Unable to achieve |
| Inner cavity | No grinding required Direct plating | Heavy grinding workload Labor and time consuming |

Figure 2:
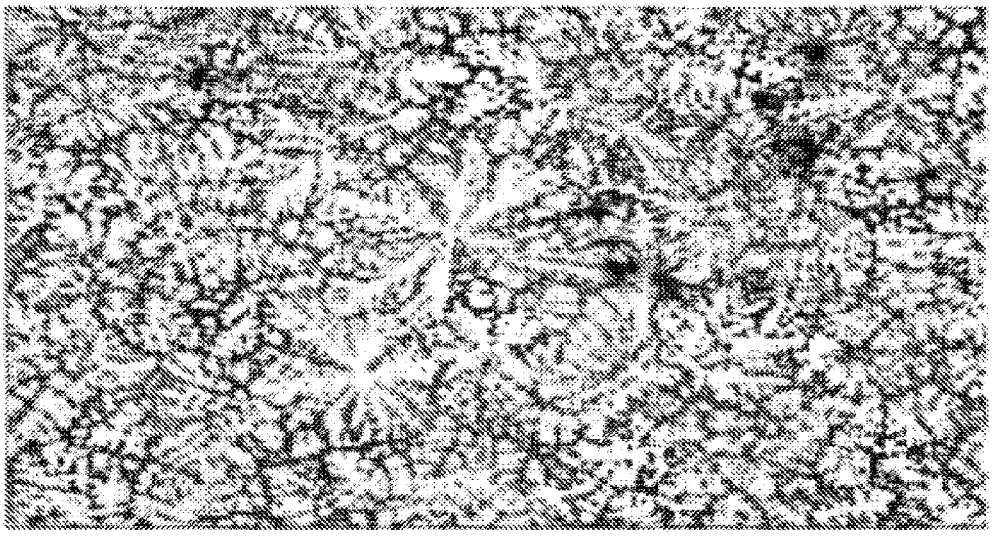
FIG. 2 shows the internal crystal structure of filtering cavity prepared by a conventional liquid die casting method.

According to FIGS. 1 and 2, the crystals inside the filtering cavity prepared by the die casting method of the present application are round grains with uniform size, high roundness and uniform distribution, and the crystals inside the filtering cavity prepared by the conventional liquid die casting method are irregularly distributed in a branch shape, and the size difference of crystal grain size is large.

It should be noted that, in this context, the terms "include," "including" or any other variant thereof are intended to cover non-exclusive inclusion, so that an article or equipment including a series of elements includes not only those elements, but also other elements not explicitly listed, or elements inherent to such an article or equipment. Without further restrictions, elements defined by the sentence "includes . . . " do not exclude the existence of other identical elements in the articles or equipment including the elements.

The above embodiments are only used to illustrate the technical solution of the present application, but not to limit it, and the present application is described in detail only with reference to the preferred embodiments. Those of ordinary skill in the art should understand that the technical solution of the present application can be modified or equivalently replaced without departing from the spirit and scope of the technical solution of the present application, which should be covered by the claims of the present application.

INDUSTRIAL APPLICABILITY

According to the die casting method of the filtering cavity provided by the application, the filtering cavity with light weight, small cavity wall thickness and high heat conduction efficiency can be obtained by using the die casting method. In addition, the present application adopts a die casting method combining electromagnetic stirring and mechanical stirring, so that the size of α-Al grains in the semisolid aluminum alloy slurry is smaller, the sphericity is higher, and the fluidity of the semisolid aluminum alloy slurry is better. The die casting method for the filtering cavity has high molding rate, can greatly reduce the subsequent blank processing process, reduce the processing cost and energy consumption, and has short solidification time and low processing temperature It does not only improves the dimensional accuracy of the filtering cavity, but also improves the productivity of products, and is suitable for industrial production.

What is claimed is:

1. A die casting method for a filtering cavity comprising:

transferring an aluminum alloy liquid to a stirrer including:

an electromagnetic inductor; and a stirring rod arranged across an inside of the stirrer;

covering the stirrer and evacuating air inside the stirrer;

starting the stirrer to stir the aluminum alloy liquid under an airtight vacuum condition, the aluminum alloy liquid being simultaneously subjected to:

an electromagnetic stirring in a direction of a magnetic field generated by the electromagnetic inductor; and a mechanical stirring under a rotation action of the stirring rod;

continuing stirring the aluminum alloy liquid for 20-80 minutes until the aluminum alloy liquid becomes semisolid to obtain a semisolid aluminum alloy slurry, a temperature of the semisolid aluminum alloy slurry being 550-650° C.; and injecting the semisolid aluminum alloy slurry into a filter die to perform die casting molding at an injection speed of 1.5-2.5 m/s, an injection specific pressure of 30-80 MPa, a pressurization pressure of 60-80 MPa, and a temperature of the filter die of 250-400° C., and maintaining pressure for 7-30 seconds to obtain the filtering cavity.

2. The die casting method according to claim 1, further comprising, before transferring the aluminum alloy liquid to the stirrer:

preparing an aluminum alloy; and heating the aluminum alloy to melt to obtain the aluminum alloy liquid with a temperature of 700-750° C.

3. The die casting method according to claim 2, further comprising, before transferring the aluminum alloy liquid to the stirrer:

placing the aluminum alloy liquid obtained by melting the aluminum alloy into a spraying device;

carrying out powder spraying refining with inert gas as a carrier to perform primary degassing to remove bubbles in the aluminum alloy liquid for a refining time of 8-18 minutes; and filtering the aluminum alloy liquid after letting the aluminum alloy liquid stand for 15-30 minutes after refining.

4. The die casting method according to claim 3, further comprising, before transferring the aluminum alloy liquid to the stirrer:

transferring the aluminum alloy liquid refined by powder spraying to a rotor degassing device; and blowing nitrogen into the aluminum alloy liquid for secondary degassing with a rotor speed of the rotor degassing device being 500-600 rpm.

5. The die casting method according to claim 1, wherein the mechanical stirring by the stifling rod includes a repeated rotary stifling from a center of the stirrer to an edge of the stirrer.

6. The die casting method according to claim 5, wherein the mechanical stirring by the stifling rod further includes stirring up and down.

7. The die casting method according to claim 1, wherein the mechanical stirring by the stifling rod includes stirring up and down.

8. The die casting method according to claim 1, wherein the stirring rod includes a graphite stirring rod.

9. The die casting method according to claim 1, wherein the magnetic field generated by the electromagnetic inductor of the stirrer includes at least one of a rotating magnetic field or a traveling wave magnetic field.

10. The die casting method according to claim 1, further comprising, after the filtering cavity is obtained:

subjecting the filtering cavity after the die cast molding to solution treatment at 545-550° C. for 6-8 hours; and water quenching the filtering cavity after the solution treatment.

11. The die casting method according to claim 10, further comprising, after water quenching:

subjecting the filtering cavity quenched in water to aging treatment at 185-250° C. for 3-5 hours.

* * * * *